US009012382B2

(12) United States Patent
Gray et al.

(10) Patent No.: US 9,012,382 B2
(45) Date of Patent: Apr. 21, 2015

(54) LUBRICATING OIL COMPOSITION

(75) Inventors: Christopher Gray, Wantage (GB); Robert William Shaw, Abingdon (GB); Doyle Harold Boese, Plainfield, NJ (US)

(73) Assignee: Infineum International Limited (GB)

( * ) Notice: Subject to any disclaimer, the term of this patent is extended or adjusted under 35 U.S.C. 154(b) by 40 days.

(21) Appl. No.: 11/775,247

(22) Filed: Jul. 10, 2007

(65) Prior Publication Data

US 2008/0020950 A1 Jan. 24, 2008

(30) Foreign Application Priority Data

Jul. 19, 2006 (EP) ..... 06117521

(51) Int. Cl.
*C10M 125/24* (2006.01)
*C10M 167/00* (2006.01)

(52) U.S. Cl.
CPC ..... *C10M 167/00* (2013.01); *C10M 2205/02* (2013.01); *C10M 2205/022* (2013.01); *C10M 2205/024* (2013.01); *C10M 2205/026* (2013.01); *C10M 2205/04* (2013.01); *C10M 2205/06* (2013.01); *C10M 2209/084* (2013.01); *C10M 2215/28* (2013.01); *C10M 2219/046* (2013.01); *C10N 2210/02* (2013.01); *C10N 2230/04* (2013.01); *C10N 2230/06* (2013.01); *C10N 2230/40* (2013.01); *C10N 2230/42* (2013.01); *C10N 2230/43* (2013.01); *C10N 2230/45* (2013.01)

(58) Field of Classification Search
CPC ..... C10M 125/24
USPC ..... 508/185, 192, 198, 149
See application file for complete search history.

(56) References Cited

U.S. PATENT DOCUMENTS

| | | | | |
|---|---|---|---|---|
| 5,346,635 | A | 9/1994 | Khorramian | 252/33.3 |
| 6,423,670 | B2 * | 7/2002 | Locke et al. | 508/192 |
| 6,569,818 | B2 | 5/2003 | Nakazato et al. | |
| 6,605,572 | B2 * | 8/2003 | Carrick et al. | 508/198 |
| 6,777,378 | B2 | 8/2004 | Abraham et al. | |
| 7,018,958 | B2 * | 3/2006 | Arrowsmith et al. | 508/185 |

FOREIGN PATENT DOCUMENTS

| | | | | |
|---|---|---|---|---|
| EP | 0 355 895 | A2 | 2/1990 | C08F 8/46 |
| EP | 1 167 497 | A2 | 1/2002 | C10M 169/04 |
| JP | 2001303087 | A | 10/2001 | |
| JP | 2002053888 | A | 2/2002 | |
| JP | 2004143458 | A | 5/2004 | |
| JP | 2004521176 | A | 7/2004 | |
| JP | 2005517798 | A | 6/2005 | |
| WO | WO 03/070863 | A3 | 8/2003 | |

* cited by examiner

*Primary Examiner* — Duane Smith
*Assistant Examiner* — Chantel Graham

(57) ABSTRACT

An internal-combustion engine lubricating oil composition has a P content of not greater than 0.09 mass %; a S content of not greater than 0.3 mass %; and a sulphated ash content of not greater than 1 mass %. It contains the following additives: as sole ashless, nitrogen-containing dispersant, and providing from 0.03 to 0.07 mass % of nitrogen in the lubricating oil composition, at least one ashless, nitrogen-containing derivative of a polyalkenyl-substituted mono- or dicarboxylic acid, anhydride or ester, the polyalkenyl-substituted mono- or dicarboxylic acid, anhydride or ester being made from a polyalkene exclusively by the thermal "ene" reaction; as sole overbased metal detergent, at least one overbased alkaline earth metal sulfonate; and at least one viscosity modifier.

2 Claims, No Drawings

LUBRICATING OIL COMPOSITION

FIELD OF THE INVENTION

This invention relates to internal combustion engine crankcase lubricating oil compositions (or lubricants), more especially to compositions suitable for use in passenger car piston engine, especially gasoline (spark-ignited) and diesel (compression-ignited), lubrication; and to use of additives in such compositions.

BACKGROUND OF TUE INVENTION

A crankcase lubricant is oil used for general lubrication in an internal combustion engine where an oil sump is situated generally below the crankshaft of the engine and to which circulated oil returns. It is well-known to include additives in crankcase lubricants for several purposes.

There has been a need and/or requirement to reduce the level of phosphorus in crankcase lubricants in order to improve the durability of exhaust gas treatment catalysts. Reduction in phosphorus levels can, however, cause increased wear in the engine.

WO 2005/012468 A1 ('468) describes the use of a combination of dispersants to provide a proper balance of seal compatibility, corrosion protection, and antiwear performance required in modern low phosphorus-low sulphur lubricants for heavy duty diesel engines. In '468, an example of the combination of dispersants comprises products of an amine, an alcohol, or an amino alcohol, with a hydrocarbyl-substituted succinic anhydride component, when the latter component comprises: (a) 10 to 95 weight percent of a component prepared by reacting a polyisobutylene with maleic anhydride in the presence of chlorine; and (b) 5 to 90 weight percent of a component prepared by reacting a polyisobutylene with maleic anhydride in the substantial absence of chlorine.

A problem in the disclosure of '468 is that, although it discusses wear and describes the HFRR wear seal test and the High Temperature Cameron Plint Test, it does not concern itself with cam and lifter wear. Cam-plus-lifter wear is one of the parameters of the sequence IIIG test, which is an API Category SM, ILSAC Category GF-4 test carried out during high temperature conditions and which simulates high-speed service during relatively high ambient temperature conditions. Moreover, '468 does not discuss or describe piston deposits. A further problem of '468 is that it mandates the use of finite levels of chlorine which are usually regarded as undesirable for environmental reasons.

SUMMARY OF THE INVENTION

The present invention meets the above problems by using an ashless, nitrogen-containing dispersant that is substantially chlorine-free, being derived from a functionalised polyalkene made by the thermal "ene" reaction, and that exhibits superior cam and lifter wear, piston deposition and/or viscosity properties in lubricants.

In a first aspect, the invention provides an internal-combustion engine crankcase lubricating oil composition having a phosphorus content, expressed as atoms of phosphorus, of no greater than 0.09, such as 0.05 to 0.08, mass %; a sulphur content, expressed as atoms of sulphur, of not greater than 0.3, such as not greater than 0.2, mass %; and a sulphated ash content of not greater than 1, such as in the range of 0.5 to 0.8, mass %, which composition contains, or is made by admixing, the following additive components in respective minor amounts:

A. at least one oil-soluble or oil-dispersible nitrogen-containing derivative of a polyalkenyl-substituted mono- or dicarboxylic acid, anhydride or ester, the polyalkenyl-substituted mono- or dicarboxylic acid, anhydride or ester being made from a polyalkene exclusively by the thermal "ene" reaction, being the sole ashless, nitrogen-containing dispersant in the lubricating oil composition and providing from 0.03 to 0.07 mass % of nitrogen in the lubricating oil composition;

B. at least one oil-soluble or oil-dispersible overbased alkaline earth metal sulfonate, being the sole overbased metal detergent system in the lubricating oil composition; and C. at least one viscosity modifier.

In a second aspect, the invention provides a method of lubricating the crankcase of a passenger car internal combustion engine which comprises supplying to the crankcase a lubricating oil composition according to the first aspect of the invention.

In a third aspect, the invention provides the use of a dispersant composition as defined in the first aspect of the invention to improve the cam and lifter wear, the piston deposits and/or the lubricant viscosity in the crankcase lubrication of a passenger car internal-combustion engine by a lubricating oil composition according to the first aspect of the invention, in comparison with use of a corresponding lubricating composition that includes a corresponding dispersant composition where the polyalkenyl-substituted mono- or dicarboxylic acid, anhydride or ester is made from a polyalkene by a chlorination reaction.

In this specification, the following words and expressions, if and when used, have the meanings ascribed below:

"active ingredient" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means in excess of 50 mass % of a composition;

"minor amount" means less than 50 mass % of a composition;

"TBN" means total base number as measured by ASTM D2896.

Furthermore in this specification:

"phosphorus content" is as measured by ASTM D5185;

"sulphated ash content" is as measured by ASTM D874;

"sulphur content" is as measured by ASTM D2622;

"KV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating, where appropriate, to each and all aspects of the invention, will now be described in more detail as follows:

Lubricating Oil Composition

This contains an oil of lubricating viscosity in a major proportion, sometimes referred to as the base oil or base stock, as the primary liquid constituent of the composition into which additives and possibly other oils are blended. The lubricating oil composition contains a dispersant providing from 0.03 to 0.07 mass % of nitrogen therein thereby classifying the composition as a passenger car motor oil (PCMO) for gasoline engines or a passenger car diesel engine (PCDO) for light duty diesel engines.

A base oil may be selected from natural (vegetable, animal or mineral) and synthetic lubricating oils and mixtures thereof. It may range in viscosity from light distillate mineral oils to heavy lubricating oils such as gas engine oil, mineral lubricating oil, motor vehicle oil and heavy duty diesel oil. Generally the viscosity of the oil ranges from 2 to 30, especially 5 to 20, $mm^2s^{-1}$ at 100° C.

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyks, alkylated polyphenols); and alkylated diphenyl ethers and alkylated diphenyl sulfides and derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl flumarate, dioctyl sebacate, diisooctyl azelate, duisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerytlhritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch-synthesised hydrocarbons made from synthesis gas containing hydrogen and carbon monoxide using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Base oil may be categorised in Groups I to V according to the API EOLCS 1509 definition. Preferred is a Group II basestock, i.e. containing greater than or equal to 90 percent saturates and less than or equal to 0.03 percent sulphur and having a viscosity index greater than or equal to 80 and less than 120.

The oil of lubricating viscosity is provided in a major amount, in combination with a minor amounts of the additives (A), (B) and (C) and, if necessary, one or more co-additives such as described hereinafter, constituting the lubricating oil composition. This preparation may be accomplished by adding the additive or additives directly to the oil or by adding it or them in the form of a concentrate thereof to disperse or dissolve the additive(s). Additives may be provided in the oil by any method known to those skilled in the art, either prior to, contemporaneously with, or subsequent to, addition of other additives. Thus, each of the components can be added directly to the base stock or base oil blend by dispersing or dissolving it in the base stock or base oil blend at the desired level of concentration. Such blending may be done at ambient temperature or at an elevated temperature.

Preferably, all the additives except for the viscosity modifier and a pour point depressant (if to be included) are blended into a concentrate or additive package that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880.

The final crankcase lubricating oil composition may employ from 2 to 20, preferably 4 to 18, and most preferably 5 to 17, mass % of the concentrate or additive package, the remainder being base stock.

The terms "oil-soluble" or "oil-dispersible", or cognate terms, used herein do not necessarily indicate that the compounds or additives are soluble dissolvable, miscible, or are capable or being suspended in the oil in all proportions. They do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Dispersant (A)

A characterising feature of the ashless, nitrogen-containing dispersants is that they are made from polyalkenes that have been functionalised exclusively by the thermal "ene"

reaction, a known reaction. Such polyalkenes are mixtures having predominantly terminal vinylidene groups, such at least 65, e.g. 70, more preferably at least 85, %. As an example, there may be mentioned a polyalkene known as highly reactive polyisobutene (HR-PIB), which is commercially available under the tradenames Glissopal™ (ex BASF) and Ultravis (ex BP-Amoco). U.S. Pat. No. 4,152,499 describes the preparations of such polymers.

In contrast, polyisobutene that has been functionalised by the so-called chlorination method, (i.e. not relating to the invention) has a minor percentage of its polymer chains (e.g. less than 20%) with terminal vinylidene groups.

The polyalkene is functionalized, for example, with carboxylic acid producing moieties (preferably acid or anhydride) by reacting the polymer using the thermal "ene" reaction under conditions that result in the addition of functional moieties or agents, i.e., acid, anhydride, or ester moieties, onto the polymer chains primarily at sites of carbon-to-carbon unsaturation (also referred to as ethylenic or olefinic unsaturation).

Preferred monounsaturated reactants that may be used to functionalize the polyalkene comprise mono- and dicarboxylic acid material, i.e., acid, anhydride, or acid ester material, including (i) monounsaturated $C_4$ to $C_{10}$ dicarboxylic acid wherein (a) the carboxyl groups are vicinyl, (i.e., located on adjacent carbon atoms) and (b) at least one, preferably both, of said adjacent carbon atoms are part of said mono unsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated with the carboxy group, i.e., of the structure —C═C—CO—; and (iv) derivatives of (iii) such as $C_1$ to $C_5$ alcohol derived mono- or diesters of (iii). Mixtures of monounsaturated carboxylic materials (i)-(iv) also may be used. Upon reaction with the polyalkene, the monounsaturation of the monounsaturated carboxylic reactant becomes saturated. Thus, for example, maleic anhydride becomes polyalkene-substituted succinic anhydride, and acrylic acid becomes polyalkene-substituted propionic acid. Exemplary of such monounsaturated carboxylic reactants are fumaric acid, itaconic acid, maleic acid, maleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, and methyl fumarate.

To provide the required functionality, monounsaturated carboxylic reactants, preferably maleic anhydride, typically will be used in an amount ranging from equimolar to 100, preferably 5 to 50, wt. % excess, based on the moles of polyalkene. Unreacted excess monounsaturated carboxylic reactant can be removed from the final dispersant product by, for example, stripping, usually under vacuum, if required.

The functionalised oil-soluble polyalkene is then derivatized with a nucleophilic reactant, such as an amine, amino-alcohol, alcohol, or mixture thereof, to form a corresponding derivative containing the dispersant. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitrites and imidazoline groups. Particularly useful amine compounds include mono- and polyamines, e.g., polyalkene and polyoxyalkylene polyamines of 2 to 60, such as 2 to 40 (e.g., 3 to 20), total carbon atoms having 1 to 12, such as 3 to 12, preferably 3 to 9, most preferably 6 to 7, nitrogen atoms per molecule. Mixtures of amine compounds may advantageously be used. Preferred amines are aliphatic saturated amines, including, for example, 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene) triamine. Such polyamine mixtures, known as PAM, are commercially available. Particularly preferred polyamine mixtures are mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

Other useful amine compounds include: alicyclic diamines such as 1,4-di(aminomethyl)cyclohexane and heterocyclic nitrogen compounds such as imidazolines. Another useful class of amines is the polyamido and related amido-amines as disclosed in U.S. Pat. Nos. 4,857,217; 4,956,107; 4,963,275; and 5,229,022. Also usable is tris(hydroxymethyl)amino methane (TAM) as described in U.S. Pat. Nos. 4,102,798; 4,113,639; 4,116,876; and UK 989,409. Dendrimers, star-like amines, and comb-structured amines may also be used. Similarly, condensed amines, as described in U.S. Pat. No. 5,053,152 may be used. The functionalized polymer is reacted with the amine compound using conventional techniques as described, for example, in U.S. Pat. Nos. 4,234,435 and 5,229,022, as well as in EP-A-208,560.

The dispersants obtained and employed in the present invention are nitrogen-containing, ashless (metal-free) dispersants. The functional groups are capable of associating with particles to be dispersed. The nitrogen-containing groups, provided by derivatization, are polar groups attached to the polymer backbone, often via a bridging group. A suitable ashless dispersant may be, for example, selected from oil-soluble salts, esters, amino-esters, amides, imides and oxazolines of long chain hydrocarbon-substituted mono- and polycarboxylic acids or anhydrides thereof; thiocarboxylate derivatives of long chain hydrocarbons; and long chain aliphatic hydrocarbons having polyamine moieties attached directly thereto.

A dispersant of the present invention preferably comprises at least one dispersant that is derived from polyalkenyl-substituted mono- or dicarboxylic acid, anhydride or ester, which dispersant has a polyalkenyl moiety with a number average molecular weight of at least 900 and from greater than 1.3 to 1.7, preferably from greater than 1.3 to 1.6, most preferably from greater than 1.3 to 1.5, functional groups (mono- or dicarboxylic acid producing moieties) per polyalkenyl moiety (a medium functionality dispersant). Functionality (F) can be determined according to the following formula:

$$F=(SAP\times M_n)/((112{,}200\times A.I.)-(SAP\times 98)) \quad (1)$$

Wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer; and A.I. is the percent active ingredient of the succinic-containing reaction product (the remainder being unreacted olefin polymer, succinic anhydride and diluent).

Generally, each mono- or dicarboxylic acid-producing moiety will react with a nucleophilic group (amine, alcohol, amide or ester polar moieties) and the number of functional groups in the polyalkenyl-substituted carboxylic acylating agent will determine the number of nucleophilic groups in the finished dispersant.

The polyalkenyl moiety of the dispersant of the present invention may have a number average molecular weight of at least 900, suitably at least 1500, preferably between 1800 and 3000, such as between 2000 and 2800, more preferably from about 2100 to 2500, and most preferably from about 2200 to about 2400. The molecular weight of a dispersant is generally expressed in terms of the molecular weight of the polyalkenyl moiety; this is because the precise molecular weight range of the dispersant depends on numerous parameters including the type of polymer used to derive the dispersant, the number of functional groups, and the type of nucleophilic group employed.

Polymer molecular weight, specifically $\overline{M}_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (see, e.g., ASTM D3592).

The polyalkenyl moiety in a dispersant of the present invention preferably has a narrow molecular weight distribution (MWD), also referred to as polydispersity, as determined by the ratio of weight average molecular weight ($M_w$) to number average molecular weight ($M_n$). Polymers having a $M_w/M_n$ of less than 2.2, preferably less than 2.0, are most desirable. Suitable polymers have a polydispersity of from about 1.5 to 2.1, preferably from about 1.6 to about 1.8.

Suitable polyalkenes employed in the formation of the dispersants of the present invention include homopolymers, interpolymers or lower molecular weight hydrocarbons. One family of such polymers comprise polymers of ethylene and/or at least one $C_3$ to $C_2$ alpha-olefin having the formula $H_2C{=}CHR^1$ wherein $R^1$ is a straight or branched chain alkyl radical comprising 1 to 26 carbon atoms and wherein the polymer contains carbon-to-carbon unsaturation, and a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms Another useful class of polymers is polymers prepared by cationic polymerization of monomers such as isobutene and styrene. Common polymers from this class include polyisobutenes obtained by polymerization of a $C_4$ refinery stream having a butene content of 35 to 75% by wt., and an isobutene content of 30 to 60% by wt., by the thermal "ene" reaction. A preferred source of monomer for making poly-n-butenes is petroleum feedstreams such as Raffinate II. These feedstocks are disclosed in the art such as in U.S. Pat. No. 4,952,739. A preferred embodiment utilizes polyisobutylene prepared from a pure isobutylene stream or a Raffinate I stream to prepare reactive isobutylene polymers with terminal vinylidene olefins as described above.

Polyisobutene polymers that may be employed are generally based on a polymer chain of from 1500 to 3000.

The dispersant(s) of the invention are preferably non-polymeric (e.g., are mono- or bis-succinimides).

The dispersant(s) of the present invention can be borated by conventional means, as generally taught in U.S. Pat. Nos. 3,087,936, 3,254,025 and 5,430,105. Boration of the dispersant is readily accomplished by treating an acyl nitrogen-containing dispersant with a boron compound such as boron oxide, boron halide boron acids, and esters of boron acids, in an amount sufficient to provide from 0.1 to 20 atomic proportions of boron for each mole of acylated nitrogen composition.

The boron, which appears in the product as dehydrated boric acid polymers (primarily $(HBO_2)_3$), is believed to attach, for example, to dispersant imides and diimides as amine salts. e.g., the metaborate salt of the diimide. Boration can be carried out by adding a sufficient quantity of a boron compound, preferably boric acid, usually as a slurry, to the acyl nitrogen compound and heating with stirring at from 135C to 190, e.g., 140 to 170, ° C., for from 1 to 5 hours, followed by nitrogen stripping. Alternatively, the boron treatment can be conducted by adding boric acid to a hot reaction mixture of the dicarboxylic acid material and amine, while removing water. Other post-reaction processes known in the art can also be applied.

Typically, the lubricating oil composition may contain from 0.1 to 20, such as 1 to 8, preferably 2 to 6, mass % dispersant.

Detergent (B)

The present invention requires the presence of one or more overbased alkaline earth detergents, e.g. having a TBN of 150 to 450, consisting of at least one alkaline earth metal sulfonate. These detergents may be present in such amounts to provide their normal attendant functions so long as the sulfated ash content of the oil remains at not greater than 1, such as 0.8 or less, wt. % and generally are used in amounts of from 0.5 to 3 wt. %. The alkaline earth metal may be calcium or magnesium, preferably calcium.

Sulfonates may be prepared from sulfonic acids, which are typically obtained by the sulfonation of alkyl-substituted aromatic hydrocarbons such as those obtained from the fractionation of petroleum or by the alkylation of aromatic hydrocarbons. Alkaryl sulfonates usually contain from 9 to 80 or more, preferably from 16 to 60, carbon atoms per alkyl substituted aromatic moiety.

Viscosity Modifiers (C)

These function to impart high and low temperature operability to a lubricating oil. The VM used may have that sole function, or may be multifunctional.

Multifunctional viscosity modifiers that also function as dispersants are also own.

Suitable viscosity modifiers are polyisobutylene, copolymers of ethylene and propylene and higher alpha-olefins, polymethacrylates, polyalkylmethacylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

They may constitute 0.01 to 10, such as 0.25 to 3, mass % of the lubricating oil composition.

Other Additives

Other additives, such as the following, may also be present in the lubricating oil compositions of the present invention.

Anti-wear agents may comprise dihydrocarbyl dithiophosphate metal salts wherein the metal may be an alkali or alkaline earth metal, or aluminum, lead, tin, molybdenum, manganese, nickel, copper, or preferably, zinc.

Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound.

For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The preferred zinc dihydrocarbyl dithiophosphates (ZDDP) are oil-soluble salts of dihydrocarbyl dithiophosphoric acids and may be represented by the following formula:

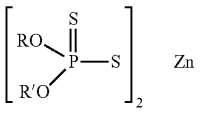

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

To limit the amount of phosphorus introduced into the lubricating oil composition by ZDDP to no more than 0.09 mass %, the ZDDP should preferably be added to the lubricating oil compositions in amounts no greater than from 1.1 to 1.3 mass %, based upon the total mass of the lubricating oil composition.

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, aromatic amines, alkaline earl metal salts of alkylphenolthioesters having preferably $C_5$ to $C_{12}$ alkyl side chains, calcium nonylphenol sulfides, ashless oil soluble phenates and sulfurized phenates, phosphosulfurized or sulfurized hydrocarbons, phosphorus esters, metal thiocarbamates and oil-soluble copper compounds as described in U.S. Pat. No. 4,867,890.

Friction Modifiers which include boundary lubricant additives that lower friction coefficient and hence improve fuel economy may be used. Examples include ester-based organic friction modifiers such as partial fatty acid esters of polyhydric alcohols, for example, glycerol monooleate; and amine-based organic frication modifiers. Further examples are additives that deposit molybdenum disulphide such as organomolybdenum compounds where the molybdenum is, for example, in dinuclear or trinuclear form.

Rust inhibitors selected from the group consisting of non-ionic polyoxyalkylene polyols and esters thereof polyoxyalkylene phenols, and anionic alkyl sulfonic acids may be used.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

Engines

The invention is applicable to a passenger car internal combustion engines such as spark-ignited and light duty compression-ignited two- or four-stroke reciprocating engines.

EXAMPLES OF THE INVENTION

The invention will now be particularly described in the following examples which are not intended to limit the scope of the claims hereof.

Two fully-formulated 5W30 lubricating oil compositions (or lubricants), Lubricant 1 and Lubricant A, were blended by methods known in the art. The two lubricants differed in that:

Lubricant 1, a lubricant of the invention, contained an ashless dispersant consisting of a polyisobutenyl-succinimide, in which the polyisobutenyl moiety was derived from polyisobutene succinic anhydride made by the thermal "ene" reaction; and Lubricant A, a reference lubricant, contained an ashless dispersant corresponding to that contained in Lubricant 1 except that the polyisobutenyl moiety was derived from polyisobutene succinic anhydride made by the chlorine process.

Each lubricant was made by admixing:

3.2 mass % of the dispersant;

1.6 mass % of a hi TBN Ca sulfonate detergent;

10 mass % of an olefin copolymer viscosity modifier and a Group II basestock, including corresponding amounts of co-additives known in the art such as one or more anti-wear agents, antioxidants, friction modifiers and anti-foamants.

Also, each lubricant had the following aalyses:—

0.77 mass % sulphated ash 0.08 mass % phosphorus 0.2 mass % sulphur

Each of the two lubricants was tested for cam and lifter wear according to the Sequence IIIG Test. The Test utilizes a 1996 General Motors 3800 cc Series II, water-cooled, 4 cycle, V-6 gasoline engine as the test apparatus. The Sequence IIIG test engine is an overhead valve design (OHV) and uses a single camshaft operating both intake and exhaust valves via pushrods and hydraulic valve lifters in a sliding-follower arrangement. Using unleaded gasoline, the engine runs a 10-minute initial oil-levelling procedure followed by a 15-minute slow ramp up to speed and load conditions. The engine then operates at 125 bhp, 3,600 rpm and 150° C. oil temperature for 100 hours, interrupted at 20-hour intervals for oil level checks.

At the end of the Test, the cam lobes and lifters were measured for wear. The results, expressed as average cam-plus-lifter wear in microns, were as follows, where the pass limit for the Test is a maximum of 60 microns.

| | |
|---|---|
| Lubricant 1 | 28.8 |
| Lubricant A | 87.2 |

The results demonstrate that the use of the dispersant in Lubricant 1 gave rise to better wear performance in an accredited engine test than use of the dispersant in Lubricant A, to the extent that Lubricant 1 passed the Test whereas Lubricant A failed.

Further tests were carried out according to the Sequence IIIG procedures on the lubricants to measure viscosity increase and piston cleanliness.

The results obtained were as follows:

| Lubricant | % Viscosity Increase | Average weighted piston deposits merits |
|---|---|---|
| 1 | 43.7 | 4.1 |
| A | 144 | 2.26 |
| Pass Limits | = or <150 | = or >3.5 |

The results show that, although both are within the Test limits, Lubricant 1 gave rise to a lower, i.e., better, viscosity increase than Lubricant A; and that Lubricant 1 gave rise to a better piston deposits performance then Lubricant A, to the extent that Lubricant 1 passed the Test whereas Lubricant A failed.

What is claimed is:

1. An internal-combustion engine crankcase lubricating oil composition having a sulphur content, expressed as atoms of sulphur, of not greater than 0.3 mass %; and a sulphated ash content of 0.5 to 0.8 mass %, which composition contains, or is made by admixing, the following additive components:

A. 2 to 6 mass % of at least one oil-soluble or oil-dispersible nitrogen-containing derivative of a polyisobutenyl-substituted mono- or dicarboxylic acid, anhydride or ester, the polyisobutenyl-substituted mono- or dicarboxylic acid or ester being made from polyisobutenyl having a number average molecular weight of from 1500 to 3000 exclusively by the thermal "ene" reaction, being the sole ashless, nitrogen-containing dispersant in the lubricating oil composition and providing from 0.03 to 0.07 mass % of nitrogen in the lubricating oil composition;

B. 0.5 to 3 mass % of at least one oil-soluble or oil-dispersible overbased calcium sulfonate, being the sole overbased metal detergent system in the lubricating oil composition, C. no greater than 1.3 mass % of a phosphorus-containing antiwear agent providing from 0.05 to 0.08 mass % of phosphorus into the lubricating oil composition, and;

D. 0.01 to 10 mass % of at least one olefin copolymer viscosity modifier.

2. A method of lubricating the crankcase of a passenger car internal combustion engine which comprises supplying to the crankcase a lubricating oil composition as claimed in claim 1.

* * * * *